US010234883B1

(12) United States Patent
Du et al.

(10) Patent No.: US 10,234,883 B1
(45) Date of Patent: Mar. 19, 2019

(54) DUAL LOOP ADAPTIVE LDO VOLTAGE REGULATOR

(71) Applicant: Apple Inc., Cupertino, CA (US)

(72) Inventors: Dingkun Du, Santa Clara, CA (US); Jay B. Fletcher, Austin, TX (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/844,765

(22) Filed: Dec. 18, 2017

(51) Int. Cl.
*G05F 1/56* (2006.01)
*G05F 1/613* (2006.01)
*G05F 1/565* (2006.01)

(52) U.S. Cl.
CPC ..... *G05F 1/613* (2013.01); *G05F 1/56* (2013.01); *G05F 1/565* (2013.01)

(58) Field of Classification Search
CPC ..... G05F 1/56; G05F 1/613; G05F 1/565
See application file for complete search history.

(56) References Cited

U.S. PATENT DOCUMENTS 7,327,125 B2 2/2008 Benbrik
8,159,207 B2 4/2012 Ivanov
9,170,594 B2 10/2015 Bhattad
9,588,541 B1 * 3/2017 Ho ..... G05F 3/267
9,746,864 B1 * 8/2017 Narang ..... G05F 1/56
2011/0285366 A1 * 11/2011 Huang ..... G05F 1/56 323/282
2015/0364928 A1 * 12/2015 Yen ..... H04B 5/0037 320/108
2017/0115678 A1 4/2017 Qing

* cited by examiner

*Primary Examiner* — Timothy J Dole
*Assistant Examiner* — Ishrat Jamali
(74) *Attorney, Agent, or Firm* — Meyertons, Hood, Kivlin, Kowert & Goetzel, P.C.; Erik A. Heter

(57) ABSTRACT

A voltage regulator circuit is disclosed. In one embodiment, a low drop-out (LDO) voltage regulator includes a voltage loop and a current loop. The current loop includes a source follower coupled to an output node of the LDO voltage regulator, the source follower being implemented with a PMOS transistor. The current loop also includes a current mirror coupled between a first branch of the current loop and a second branch of the current loop. The source follower is implemented in the second branch of the current loop. The voltage loop includes an amplifier circuit having an inverting input coupled to the output node, and a non-inverting input coupled to receive a reference voltage. The output of the amplifier is coupled to the gate terminal of the PMOS transistor of the current mirror.

16 Claims, 4 Drawing Sheets

DUAL LOOP ADAPTIVE LDO VOLTAGE REGULATOR

BACKGROUND

Technical Field

This disclosure is directed to electronic circuits, and more particularly, to voltage regulator circuits.

Description of the Related Art

Voltage regulators are commonly used in a wide variety of circuits in order to provide a desired voltage to particular circuits. To this end, a wide variety of voltage regulator circuits are available to suit various applications. Linear voltage regulators are used in a number of different applications in which the available supply voltages exceed an appropriate value for the circuitry to be powered. Accordingly, linear voltage regulators may output a voltage that is less than the received supply voltage.

Some linear voltage regulators may be implemented as stages. Each of the stages may contribute to generating the output voltage based on supplied input voltage (e.g. from the external source). The stages may be coupled to one another, with capacitors coupled to the output of each stage. These capacitors may stabilize the voltage that is output by each of the stages. In voltage regulators implemented on an integrated circuit (IC), the output of a given voltage regulator stage may be provided with an external connection for coupling to a capacitor implemented external to the IC (e.g., on a printed circuit board, or PCB).

SUMMARY

A voltage regulator circuit is disclosed. In one embodiment, a low drop-out (LDO) voltage regulator includes a voltage loop and a current loop. The current loop includes a source follower coupled to an output node of the LDO voltage regulator, the source follower being implemented with a PMOS transistor. The current loop also includes a current mirror coupled between a first branch of the current loop and a second branch of the current loop. The source follower is implemented in the second branch of the current loop. The voltage loop includes an amplifier circuit having an inverting input coupled to the output node, and a non-inverting input coupled to receive a reference voltage. The output of the amplifier is coupled to the gate terminal of the PMOS transistor of the current mirror.

In one embodiment, a method for operating the LDO voltage regulator includes the current loop controlling an amount of current provided to a load circuit, and the voltage loop controlling the output voltage. The current loop is designed to quickly sense variations and may thus quickly adjust the load current while adding stability to the voltage regulator output. The voltage loop is a slow-voltage feedback loop that fine-tunes the output voltage, and is optimized for high gain. It may be designed such that its response is slow enough to further enhance stability.

A power management unit (PMU) implemented as an integrated circuit is also disclosed. The may include a number of circuit blocks, at least one of which includes an LDO voltage regulator as discussed herein (embodiments with multiple instances of the LDO voltage regulator discussed herein are also contemplated). Since the LDO voltage regulator discussed above can be implemented without the use of external capacitors, multiple instances can be distributed on the chip, rather than a single instance with an external capacitor connection. The circuit block may include control and power circuitry, and can be coupled to distribute power to various voltage domains of the system in which it is implemented.

BRIEF DESCRIPTION OF THE DRAWINGS

The following detailed description makes reference to the accompanying drawings, which are now briefly described.

Figure 1:
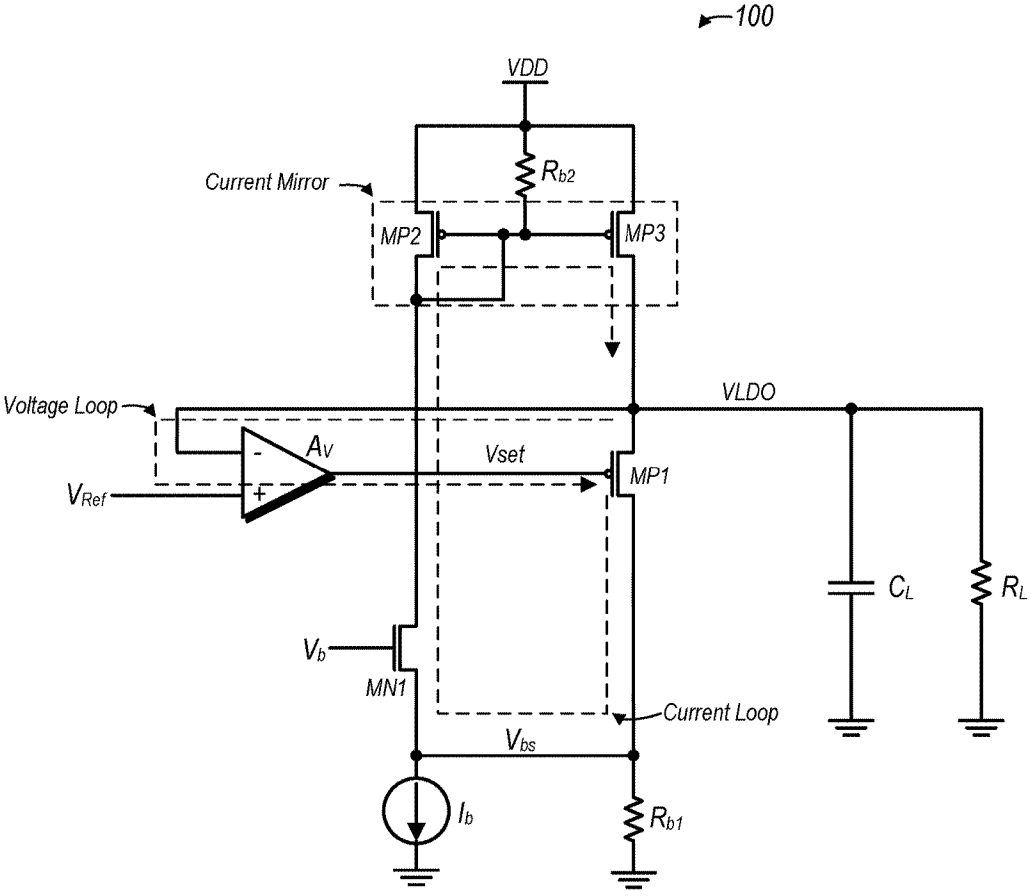
FIG. 1 is a schematic diagram of one embodiment of a voltage regulator circuit.

Although the embodiments disclosed herein are susceptible to various modifications and alternative forms, specific embodiments are shown by way of example in the drawings and are described herein in detail. It should be understood, however, that drawings and detailed description thereto are not intended to limit the scope of the claims to the particular forms disclosed. On the contrary, this application is intended to cover all modifications, equivalents and alternatives falling within the spirit and scope of the disclosure of the present application as defined by the appended claims.

This disclosure includes references to "one embodiment," "a particular embodiment," "some embodiments," "various embodiments," or "an embodiment." The appearances of the phrases "in one embodiment," "in a particular embodiment," "in some embodiments," "in various embodiments," or "in an embodiment" do not necessarily refer to the same embodiment. Particular features, structures, or characteristics may be combined in any suitable manner consistent with this disclosure.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical, such as an electronic circuit). More specifically, this formulation is used to indicate that this structure is arranged to perform the one or more tasks during operation. A structure can be said to be "configured to" perform some task even if the structure is not currently being operated. A "credit distribution circuit configured to distribute credits to a plurality of processor cores" is intended to cover, for example, an integrated circuit that has circuitry that performs this function during operation, even if the integrated circuit in question is not currently being used (e.g., a power supply is not connected to it). Thus, an entity described or recited as "configured to" perform some task refers to something physical, such as a device, circuit, memory storing program instructions executable to implement the task, etc. This phrase is not used herein to refer to something intangible.

The term "configured to" is not intended to mean "configurable to." An unprogrammed FPGA, for example, would not be considered to be "configured to" perform some specific function, although it may be "configurable to" perform that function after programming.

Reciting in the appended claims that a structure is "configured to" perform one or more tasks is expressly intended not to invoke 35 U.S.C. § 112(f) for that claim element. Accordingly, none of the claims in this application as filed are intended to be interpreted as having means-plus-function elements. Should Applicant wish to invoke Section 112(f) during prosecution, it will recite claim elements using the "means for" [performing a function] construct.

As used herein, the term "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

As used herein, the phrase "in response to" describes one or more factors that trigger an effect. This phrase does not foreclose the possibility that additional factors may affect or otherwise trigger the effect. That is, an effect may be solely in response to those factors, or may be in response to the specified factors as well as other, unspecified factors. Consider the phrase "perform A in response to B." This phrase specifies that B is a factor that triggers the performance of A. This phrase does not foreclose that performing A may also be in response to some other factor, such as C. This phrase is also intended to cover an embodiment in which A is performed solely in response to B.

As used herein, the terms "first," "second," etc. are used as labels for nouns that they precede, and do not imply any type of ordering (e.g., spatial, temporal, logical, etc.), unless stated otherwise. For example, in a register file having eight registers, the terms "first register" and "second register" can be used to refer to any two of the eight registers, and not, for example, just logical registers 0 and 1.

When used in the claims, the term "or" is used as an inclusive or and not as an exclusive or. For example, the phrase "at least one of x, y, or z" means any one of x, y, and z, as well as any combination thereof.

In the following description, numerous specific details are set forth to provide a thorough understanding of the disclosed embodiments. One having ordinary skill in the art, however, should recognize that aspects of disclosed embodiments might be practiced without these specific details. In some instances, well-known circuits, structures, signals, computer program instruction, and techniques have not been shown in detail to avoid obscuring the disclosed embodiments.

DETAILED DESCRIPTION OF EMBODIMENTS

Turning now to FIG. 1, a schematic diagram of one embodiment of a voltage regulator circuit is shown. Voltage regulator 100 in the embodiment shown is a low dropout (LDO) voltage regulator coupled to receive a voltage from an external source (VDD) and to provide an output voltage to a load on an output node (VLDO).

In the embodiment shown, voltage regulator 100 includes a voltage loop and a current loop, which are coupled to one another via PMOS transistor MP1. The voltage loop includes the amplifier $A_v$, the output of which (node Vset) is coupled to the gate terminal of MP1. The inverting input of $A_v$ is coupled to the output node, VLDO, while the non-inverting input is coupled to receive a reference voltage, $V_{Ref}$.

The current loop of voltage regulator 100 also includes MP1, which is connected in a source follower configuration (and thus, the output node VLDO is coupled to the source of MP1). The source follower arrangement as shown creates a low output impedance for voltage regulator 100. The current loop also includes a current mirror implemented using transistors MP2 and MP3, and a bias transistor. The current mirror circuit may implement a 1:N current relationship between the respective currents through MP2 and MP3 (i.e. the current through MP3 is N×the current through MP2, with N being any suitable value). The bias transistor is implemented using NMOS device MN1, which is coupled to receive a bias voltage, $V_b$, on its gate terminal. The current loop can be considered to be implemented with two separate branches, e.g., a first branch that includes the bias transistor MN1, and the second branch that includes the source follower implemented using MP1. The current mirror (and more particularly, the gate terminals of MP2 and MP3) and a bias voltage node, $V_{bs}$, close the loop by coupling the first and second branches together. Transistor MP2 of the current loop is the diode-coupled device of the current mirror, and is implemented in the first branch. Transistor MP3 of the current loop is implemented in the second branch.

Voltage regulator 100 also includes a bias current source $I_b$ and a pair of bias resistors, $R_{b1}$ and $R_{b2}$. The bias current source and bias resistor $R_{b1}$ are both coupled to the bias voltage node $V_{bs}$. The second bias resistor is coupled between the VDD and the gate terminals of MP2 and MP3.

The resistor $R_L$ and the capacitor $C_L$ represent the resistance and capacitance, respectively, of a load circuit coupled to voltage regulator 100.

The voltage loop in the illustrated embodiment is a slow, voltage feedback loop that fine-tunes the output voltage provided on VLDO. The voltage loop design in the illustrated embodiment is optimized for high gain. Furthermore, the voltage loop can be designed in such a manner that it is slow enough to enhance the overall stability of the circuit. Typically, the output of the amplifier responds slowly, and the voltage present on the Vset node is usually a D.C. voltage that changes very slowly. Although not shown here, some embodiments may add capacitance at the Vset node to further enhance stability.

The current loop in the illustrated embodiment is a current feedback loop that can quickly sense in the output and adjust the load current accordingly. This loop is optimized for high speed so as to respond to variations in the load fast enough. This ability may, along with the functioning of the voltage loop, further help maintain a stable output voltage. The result of this design, including both the voltage loop and the current loop, may allow for increased stability along with high speed in the responsiveness in adjusting to changing conditions in the load circuit. Accordingly, the design shown herein may be adaptable to a wide variety of different types of load circuits. This can mitigate the need to tune the voltage regulator to a load circuit of a specific type or design.

The design of voltage regulator 100 in the embodiment shown implements a load-adaptive mechanism. In the current mirror, the diode-coupled device MP2 senses the load current (the current through MP2 can be expressed as $I_L/N$, where $I_L$ is the load current and N is the ratio of the current of MP3 to MP2). Depending on the current through MP2, the gate-source voltage ($V_{gs}$) across transistor MN1 may change, and thus the bias voltage $V_{bs}$ may change correspondingly. When the load current is high, the current through MP2 is high, as is the gate-source voltage across MN1, while the current through MP1 and the voltage $V_{bs}$ are low. Conversely, when the current through MP2 is low, the gate-source voltage across MN1 is also low, while the bias voltage at $V_{bs}$ and the current through MP1 are both high. Generally speaking, current in the current loop may be allocated between the first branch (that includes MN1) and the second branch (that includes MP1) depending on the current drawn by the load circuit.

It is noted that the circuit shown in FIG. 1 is exemplary and is not intended to be limiting. In contrast, variations of the circuit shown in FIG. 1 are possible and contemplated while falling within the scope of the disclosure. For example, in some embodiments, it may be possible to remove the bias resistor $R_{b2}$ given certain load characteristics.

Figure 2:
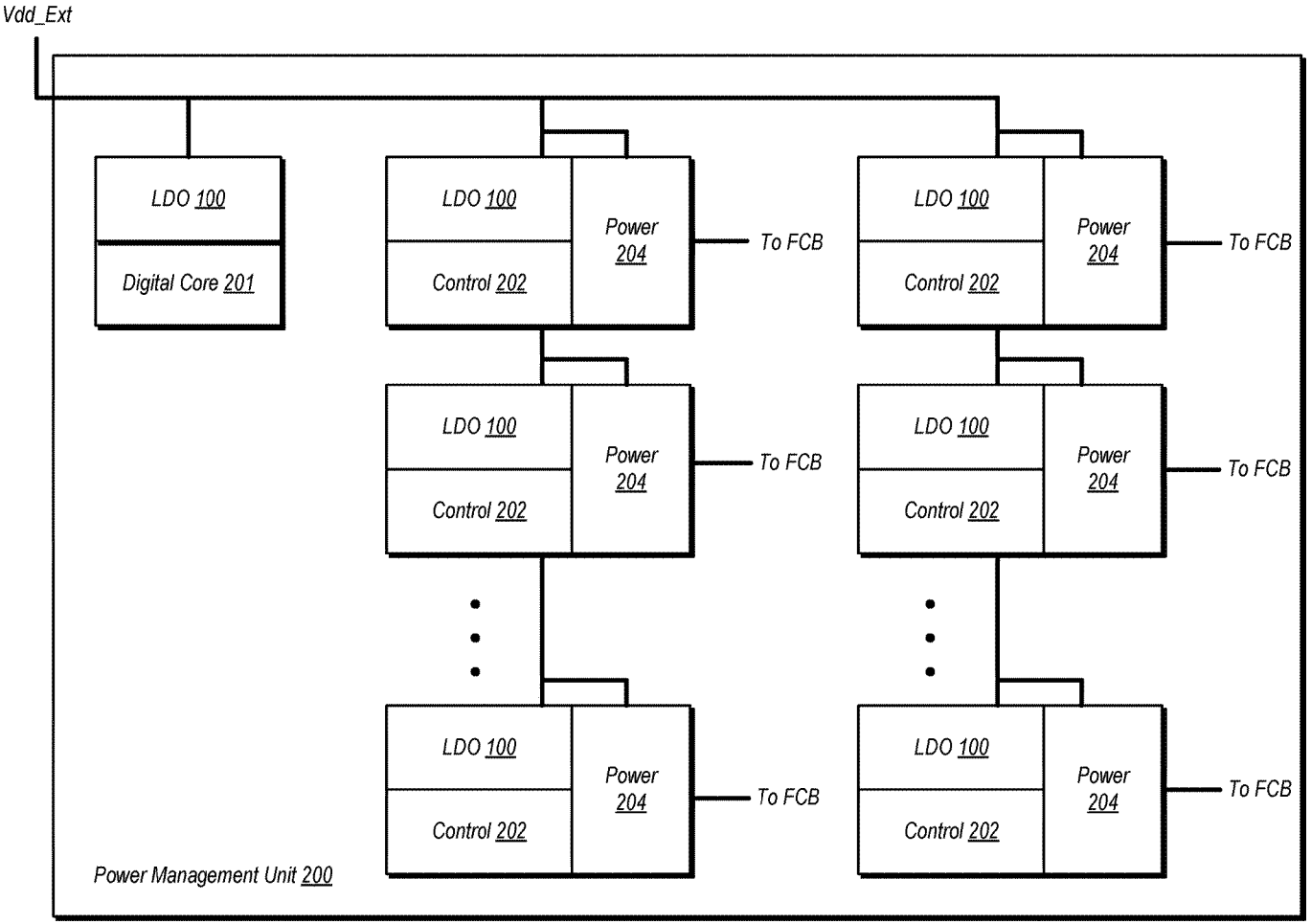
FIG. 2 is a block diagram of one embodiment of an integrated circuit.

FIG. 2 is a block diagram of one embodiment of a power management unit (PMU) implemented as circuitry on an integrated circuit. In the embodiment shown, PMU 200 includes a number of power circuits, each of which implements a version of LDO 100 as discussed above. Each LDO voltage regulator 100 in the illustrated embodiment is configured to receive its supply voltage via the power bus labeled Vdd_Ext, which may be coupled to an external power source. The external power source may be a battery, an external power supply, or any other suitable mechanism for providing power to the instances of LDO voltage regulator as shown here. At least one of the LDO voltage regulators 100 as disclosed herein may be implemented in accordance with the circuits discussed above. In particular, at least one of the LDO voltage regulators 100 may include both a current loop and a voltage loop, and may be implemented without providing any connection for external capacitors, with the only external capacitance being provided by the load circuit to which it is coupled. Embodiments with more than one of the LDO voltage regulators 100 conforming to the design discussed above are also possible and contemplated, as are embodiment in which all of the LDO voltage regulators 100 conform to the design disclosed herein.

The embodiment of PMU 200 as shown herein may be enabled at least in part by the design of LDO voltage regulator 100. In lieu of a single voltage regulator coupled to provide a regulated voltage to each of the (non-LDO) circuit blocks shown here, the provision of a regulated voltages is distributed by providing one or more instances of LDO voltage regulator 100. This is made possible in part due to the fact that the various embodiments of LDO voltage regulator 100 discussed herein have no need to be coupled to an external capacitor. Thus, the IC upon which PMU 200 is implemented does not need to provide any circuit paths for coupling an external capacitor to the various instances of LDO voltage regulator 100 for those that are implemented using a design that falls within the scope of that discussed with reference to FIG. 1.

One of the LDO voltage regulators shown in this embodiment provides a voltage to digital core 201, while the remainder are coupled to power control circuits that each include a control circuit 202 and a power circuit 204. The power circuit 204 in the various blocks may be circuitry of different types, and it is not necessary for each of the power circuits 204 to be the same type in the embodiment shown. For example, at least one of the power circuits 204 in the embodiment shown may be a switching voltage regulator that is configured to provide a voltage to a functional circuit block (FCB) that is implemented on a chip external to PMU 200 (e.g., to a particular voltage domain on another integrated circuit coupled thereto). In another embodiment, a given instance of power circuit 204 may implement a power switch that is used to allow power to be selectively applied to an FCB. An embodiment of a power circuit 204 that includes both a switching voltage regulator and a power switch is also possible and contemplated. Each of the power circuits 204 shown here is coupled to receive its supply voltage from its correspondingly coupled LDO voltage regulator 100, and is in turn, configured to provide a supply voltage to an FCB that is implemented on a different integrated circuit. It is noted, however, that the various instances of a power control circuit as shown herein may be implemented on another IC having different functionality (i.e. one that is not a PMU).

The control circuit 202 in each of the power control circuits may provide various power control functions. For example, if a corresponding power circuit 204 includes a power switch, then the control circuit 202 may include circuitry to cause the power switch to open and close, as well as to determine when such actions should be taken. In another example, if a power circuit 204 includes another voltage supply with a variable voltage output, the corresponding control circuit 202 can adjust the variable output voltage. Although not explicitly shown, at least some of the control circuits 202 may be coupled to receive information from other circuits, such as a corresponding FCB to which the power circuit 204 provides a supply voltage. Such information may include information such as activity levels, performance states (and/or requested performance states), and so forth. Generally speaking, each control circuit 202 in the embodiment shown may provide appropriate control and monitoring functions with regard to its correspondingly coupled power circuit 204. Furthermore, each of the control circuits 202 in the embodiment shown may receive its operating voltage from its correspondingly coupled LDO voltage regulator 100.

The digital core 201 in the embodiment shown may provide high level control functions for PMU 200. For example, each control circuit 202 may be coupled to provide information to digital core 201 regarding operation of its corresponding power circuit 204. In some embodiments, digital core 201 may also provide control signals to each of the various power control circuits. Digital core 201 may also perform various telemetry and system monitoring functions. Generally speaking, digital core may be any circuitry that may be utilized for control and/or monitoring functions that include those related to the distribution of power from the various power circuits 204. As with the other circuit units shown herein, digital core 201 is coupled to receive its supply voltage from an instance of LDO voltage regulator 100.

Figure 3:
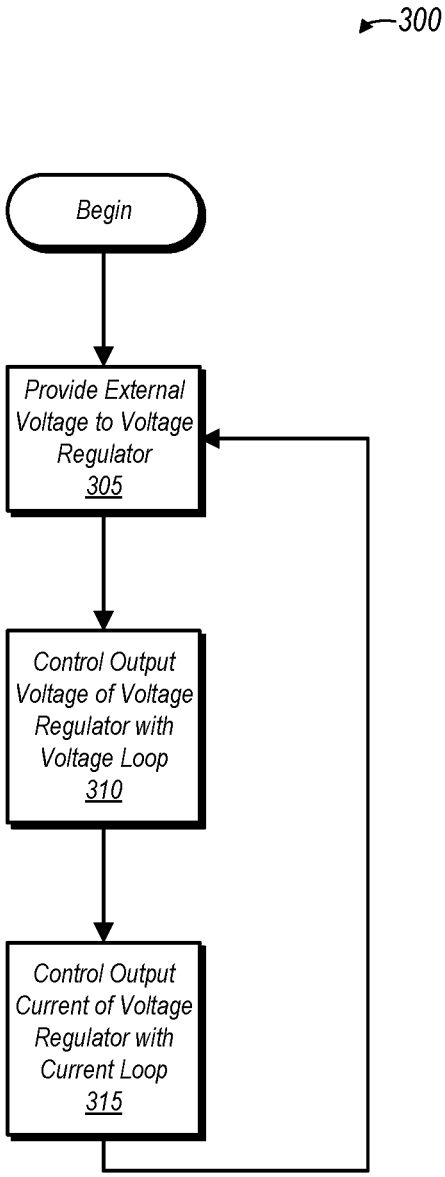
FIG. 3 is a flow diagram of one embodiment of a method for operating a voltage regulator.

FIG. 3 is a flow diagram illustrating one embodiment of a method for operating a voltage regulator circuit. Method 300 as discussed herein may be implemented with the embodiment of LDO voltage regulator 100 discussed above, as well as with embodiments not explicitly discussed herein. Such embodiments may be considered to fall within the scope of this disclosure.

Method 300 begins with the provision of an external supply voltage to an LDO voltage regulator (block 305). The LDO voltage regulator correspondingly provides a regulated output voltage as a supply voltage to other circuitry. Control of the output voltage is provided by a voltage loop of the LDO voltage regulator (block 310). Control of an output current provided by the voltage regulator is performed by a current loop of the LDO voltage regulator (block 315).

The combination of the voltage and current loops may allow various embodiments of the LDO voltage regulator to operate in a manner that maintains a stable output while providing fast response to changes in a correspondingly coupled load circuit. The current loop in particular may be a fast-responding feedback circuit that quickly responds to changes in the demand for output current by the load circuit. The voltage loop, on the other hand, may be a slow-responding feedback circuit that helps maintain a stable output voltage across a wide range of operating conditions. In combination together, the voltage and current loops enable a voltage regulator that has both a fast response time (due to changing operating conditions of the load) while providing a stable output voltage.

Figure 4:
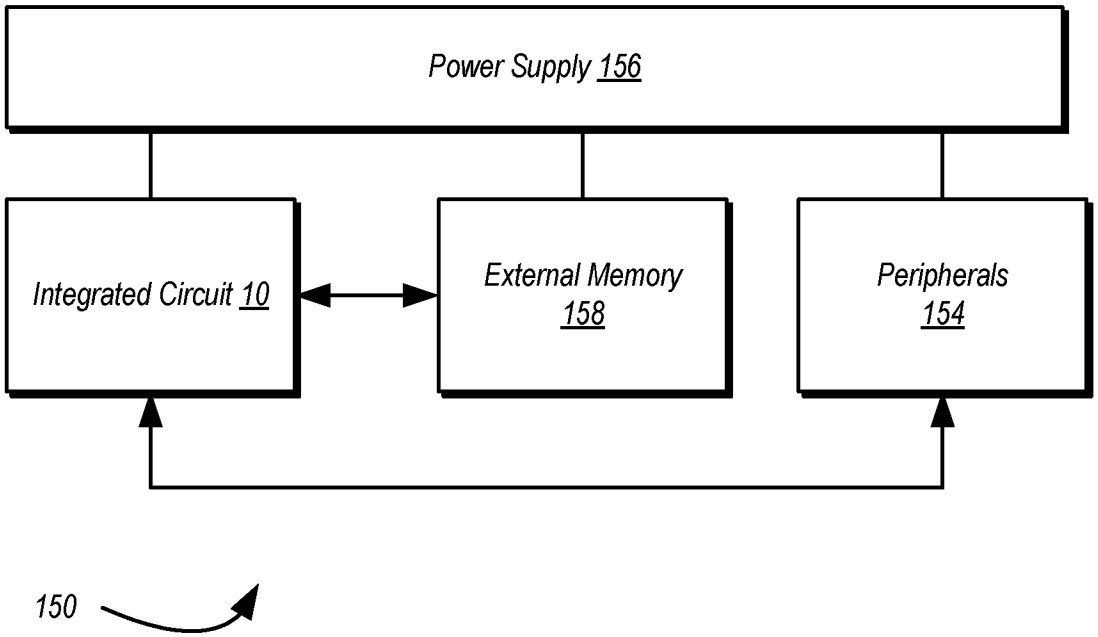
FIG. 4 is a block diagram of one embodiment of an exemplary system.

Turning next to FIG. 4, a block diagram of one embodiment of a system 150 is shown. In the illustrated embodiment, the system 150 includes at least one instance of an integrated circuit 10 coupled to external memory 158. The integrated circuit 10 may include a memory controller that is coupled to the external memory 158. The integrated circuit 10 is coupled to one or more peripherals 154 and the external memory 158. A power supply 156 is also provided which supplies the supply voltages to the integrated circuit 10 as well as one or more supply voltages to the memory 158 and/or the peripherals 154. In some embodiments, more than one instance of the integrated circuit 10 may be included (and more than one external memory 158 may be included as well).

The peripherals 154 may include any desired circuitry, depending on the type of system 150. For example, in one embodiment, the system 150 may be a mobile device (e.g. personal digital assistant (PDA), smart phone, etc.) and the peripherals 154 may include devices for various types of wireless communication, such as WiFi, Bluetooth, cellular, global positioning system, etc. The peripherals 154 may also include additional storage, including RAM storage, solid-state storage, or disk storage. The peripherals 154 may include user interface devices such as a display screen, including touch display screens or multitouch display screens, keyboard or other input devices, microphones, speakers, etc. In other embodiments, the system 150 may be any type of computing system (e.g. desktop personal computer, laptop, workstation, tablet, etc.).

The external memory 158 may include any type of memory. For example, the external memory 158 may be SRAM, dynamic RAM (DRAM) such as synchronous DRAM (SDRAM), double data rate (DDR, DDR2, DDR3, LPDDR1, LPDDR2, etc.) SDRAM, RAMBUS DRAM, etc. The external memory 158 may include one or more memory modules to which the memory devices are mounted, such as single inline memory modules (SIMMs), dual inline memory modules (DIMMs), etc.

Numerous variations and modifications will become apparent to those skilled in the art once the above disclosure is fully appreciated. It is intended that the following claims be interpreted to embrace all such variations and modifications.

What is claimed is:

1. A circuit comprising:

a low drop-out (LDO) voltage regulator comprising a voltage loop and a current loop, wherein the current loop comprises:

a source follower coupled to an output node, the source follower including a first PMOS transistor; and a current mirror coupled between a first branch of the current loop and a second branch of the current loop, wherein the source follower is implemented in the second branch;

wherein the voltage loop comprises:

an amplifier circuit having an inverting input coupled directly to the output node, a non-inverting input coupled to receive a reference voltage, and an amplifier output coupled to a gate terminal of the first PMOS transistor; and wherein the LDO voltage regulator further comprises:

a bias current source coupled between a bias voltage node and a ground node, wherein the bias voltage node is coupled between the first and second branches of the current loop;

a bias transistor coupled between the current mirror and the bias current source; and a first bias resistor coupled directly to the bias voltage node and further coupled directly to the ground node and a drain terminal of the first PMOS transistor.

2. The circuit as recited in claim 1, wherein the bias transistor includes a gate terminal coupled to receive a first bias voltage.

3. The circuit as recited in claim 1, wherein the current mirror comprises:

a second PMOS transistor, the second PMOS transistor being a diode coupled device, and wherein the second PMOS transistor is coupled between the first branch of the current loop and a supply voltage node; and a third PMOS transistor, wherein the third PMOS transistor is coupled between the second branch of the current loop and the supply voltage node.

4. The circuit as recited in claim 3, further comprising a second bias resistor coupled between the supply voltage node and respective gate terminals of the second and third PMOS transistors.

5. The circuit as recited in claim 1, further comprising a load circuit coupled to the output node, wherein a source terminal of the first PMOS transistor is coupled to the output node.

6. The circuit as recited in claim 1, wherein the current loop is configured to control an amount of load current provided to a load circuit coupled to the voltage regulator, and wherein the voltage loop is configured to control an output voltage provided to the load circuit.

7. A method comprising:

providing a source voltage to a low drop-out (LDO) voltage regulator comprising a voltage loop and a current loop;

controlling an output voltage of the LDO voltage regulator using the voltage loop, the voltage loop having an amplifier circuit coupled to a gate terminal of a first PMOS transistor of a source follower in the current loop, wherein a source of the first PMOS transistor is coupled to an output node of the LDO voltage regulator; and controlling a load current using the current loop, the current loop further comprising a current mirror, wherein the current mirror comprises second and third PMOS transistors, wherein the second PMOS transistor is diode-coupled, and wherein the current loop further comprises a bias transistor coupled between the second PMOS transistor and a bias voltage node and a bias current source coupled between a bias voltage node and a ground node, wherein the bias voltage node is coupled between the first and second branches of the current loop.

8. The method as recited in claim 7, wherein the second PMOS transistor is diode-coupled, and wherein the method further comprises the second PMOS transistor sensing an amount of load current.

9. The method as recited in claim 8, wherein the method further comprises providing a first bias voltage to a gate terminal of the bias transistor.

10. The method as recited in claim 9, wherein the method further comprises the bias transistor causing a second bias voltage on the bias voltage node to change responsive to a change in the amount of load current sensed by the second PMOS transistor.

11. The method as recited in claim 10, further comprising the bias transistor causing a reduction of the second bias voltage responsive to an increase in the load current, and further comprising the bias transistor causing an increase in the second bias voltage responsive to a decrease in the load current.

12. An integrated circuit comprising:

a voltage supply node configured to be coupled to an external voltage source; and a plurality of power control circuits, wherein each of the plurality of power control circuits includes a control circuit, a power circuit, and an LDO voltage regulator, wherein the LDO voltage regulator of at least one of the plurality of power control circuits includes:

a current loop comprising a source follower coupled to an output node, the source follower including a first PMOS transistor and a current mirror coupled between a first branch of the current loop and a second branch of the current loop, wherein the source follower is implemented in the second branch, wherein the current loop further comprises a bias current source coupled between the current loop and a ground node and a bias transistor having a drain terminal coupled directly to the current mirror and a source terminal coupled directly to the bias current source, wherein the source terminal of the bias transistor and the bias current source are further coupled to a bias voltage node connecting the first and second branches of the current loop; and a voltage loop comprising an amplifier circuit having an inverting input coupled to the output node, a non-inverting input coupled to receive a reference voltage, and an amplifier output coupled to a gate terminal of the first PMOS transistor.

13. The integrated circuit as recited in claim 12, wherein the LDO voltage regulator of each of the plurality of power control circuits further includes:

a second PMOS transistor, the second PMOS transistor being a diode coupled device, and wherein the second PMOS transistor is coupled between the first branch of the current loop and a supply voltage node; and a third PMOS transistor, wherein the third PMOS transistor is coupled between the second branch of the current loop and the supply voltage node.

14. The integrated circuit as recited in claim 12, wherein the current loop of each LDO voltage regulator circuit is configured to control an amount of load current provided to a corresponding load circuit coupled to the LDO voltage regulator, and wherein the voltage loop of each LDO voltage regulator is configured to control an output voltage provided to the corresponding load circuit.

15. The integrated circuit as recited in claim 12, wherein the power circuit of at least one of the power control circuits includes a power switch configured to couple, when activated, a regulated voltage from its corresponding LDO voltage regulator to a supply voltage node for one or more functional circuit blocks, and wherein the control circuit of the at least one of the power control circuits is configured to selectively activated and deactivate the power switch.

16. The integrated circuit as recited in claim 12, wherein the power circuit of each of at least one of the plurality of power control circuits includes a switching voltage regulator coupled to receive a regulated voltage from its corresponding LDO voltage regulator.

* * * * *